US007142680B2

(12) United States Patent
Gelow et al.

(10) Patent No.: US 7,142,680 B2
(45) Date of Patent: Nov. 28, 2006

(54) MULTIPLE WAVEGUIDE COAXIAL CEILING LOUDSPEAKER

(75) Inventors: William James Gelow, Apple Valley, MN (US); Christopher Sean Beckett, Saint Paul, MN (US)

(73) Assignee: Telex, Bloomington, MN (US)

( * ) Notice: Subject to any disclaimer, the term of this patent is extended or adjusted under 35 U.S.C. 154(b) by 194 days.

(21) Appl. No.: 10/404,587

(22) Filed: Mar. 31, 2003

(65) Prior Publication Data

US 2004/0190736 A1 Sep. 30, 2004

(51) Int. Cl.
*H04R 25/00* (2006.01)

(52) U.S. Cl. ..... 381/182; 381/160; 381/186; 381/337; 381/338; 381/340; 381/341

(58) Field of Classification Search ..... 381/150, 381/160, 182, 186, 162, 385, 386, 350, 337, 381/338, 340, 341, 342, 344; 181/155, 156, 181/144, 145, 147, 199
See application file for complete search history.

(56) References Cited

U.S. PATENT DOCUMENTS 4,123,621 A 10/1978 Walker
4,619,342 A * 10/1986 Buck ..... 181/184
5,088,574 A 2/1992 Kertesz, III
5,109,423 A * 4/1992 Jacobson et al. ..... 381/336
5,526,456 A * 6/1996 Heinz ..... 381/340
6,411,718 B1 6/2002 Danley et al.
6,431,309 B1 8/2002 Coffin

* cited by examiner

*Primary Examiner*—Curtis Kuntz
*Assistant Examiner*—Tuan Duc Nguyen
(74) *Attorney, Agent, or Firm*—David George Johnson

(57) ABSTRACT

A flush mountable ceiling speaker (10) with individual coaxial waveguides (20, 22) for both the lower and high-frequency transducers (11, 12). The lower frequency radiation is combined with the sonic energy radiated by the high-frequency transducer (12) and shaped by the high-frequency waveguide (20) to create a coherent, uniformly controlled coverage pattern. The loudspeaker (10) creates a well defined sound dispersion pattern over a relatively large bandwidth, resulting in increased vocal intelligibility and more accurate reproduction of music at relatively great distances from the loudspeaker, as is particularly useful in association with high ceiling installations.

15 Claims, 12 Drawing Sheets

SEC A-A

MULTIPLE WAVEGUIDE COAXIAL CEILING LOUDSPEAKER

FIELD OF THE INVENTION

The present invention relates to the field of loudspeaker systems, and more particularly it relates to loudspeaker systems for ceiling mounted applications.

BACKGROUND OF THE INVENTION

A typical loudspeaker is difficult to mount within a ceiling structure. Special ceiling loudspeakers exist which include some sort of mounting device that allows them to be affixed to a ceiling. An example of such a loudspeaker system is disclosed in U.S. Pat. No. 5,088,574, entitled CEILING SPEAKER SYSTEM, issued on Feb. 18, 1992 to Kertesz. Flush mountable ceiling speakers are loudspeakers that are mounted within a hole in a ceiling such that the front of the speaker is substantially coplanar with the surface of the ceiling. An example of such a loudspeaker is disclosed in U.S. Pat. No. 4,123,621, entitled ACOUSTICAL SPEAKER DEVICE, issued to Walker on Oct. 31, 1978.

A typical ceiling loudspeaker is a two-way system having a lower-frequency transducer that reproduces the lower frequencies and a high-frequency transducer that reproduces the higher frequencies.

One method to increase the lower-frequency output of the lower-frequency transducer is by the addition of a port to the enclosure of the lower-frequency transducer. Low frequencies are then produced not only by the movement of the lower-frequency transducer but also by the movement of air through the port. In a flush mounted ceiling speaker, the port must be on the front of the speaker in order to project the lower-frequency energy in a downward direction toward the audience rather than into the airspace above the ceiling where it will not be heard.

Another feature often incorporated into a ceiling speaker is a line transformer, which allows many speakers in a room to be powered by one amplifier. Such a loudspeaker system often includes an adjustable switch that must be accessible in order to permit the user to change the setting of the line transformer. This adjustable switch should be easily accessible at the point of speaker installation. In the case of a flush mounted ceiling speaker, the most convenient place to access this switch once the speaker is installed is on the front of the speaker.

In some loudspeaker systems the lower-frequency transducer and high-frequency transducer are mounted in a spaced apart relationship in which their various axes and planes are neither coaxial nor coplanar. An example of such a loudspeaker system is disclosed in U.S. Pat. No. 6,411,718, entitled SOUND REPRODUCTION EMPLOYING UNITY SUMMATION APERTURE LOUDSPEAKERS, issued on Jun. 25, 2002 to Danley et al. In other types of loudspeaker systems the high-frequency transducer is mounted coaxially with the lower-frequency transducer. This coaxial mounting method saves space and often provides a relatively smoother transition between lower frequencies and high frequencies when the listener is positioned off axis from the loudspeaker. In some instances the high-frequency transducer will include a horn, also known as a waveguide, in order to control the dispersion pattern of sound emanating from the loudspeaker system. An example of a coaxial speaker system including a waveguide is disclosed in U.S. Pat. No. 6,431,309, entitled LOUDSPEAKER SYSTEM, issued on Aug. 13, 2002 to Coffin.

The higher frequencies at which high-frequency transducer waveguides are effective contain only a portion of the frequencies where intelligible speech is typically present. The human voice produces sounds that appear in the frequency spectrum from between around 100 Hz to 10,000 Hz, with the majority of the vocal intelligibility residing between 500 Hz and 8000 Hz. The typical ceiling speaker includes a lower-frequency transducer that will reproduce a range of frequencies from below 100 Hz up to between 2000 and 4000 Hz (the lower and medium frequencies). The high-frequency transducer in such a speaker will typically reproduce the frequencies from between around 2000 and 4000 Hz up to 20,000 Hz (the high frequencies). The high-frequency transducer often does not produce high levels of sound in the frequency band below 2000 Hz. The high-frequency waveguide that controls the high-frequency transducer dispersion pattern is only effective over the frequency range of the high-frequency transducer to which it is coupled. Such an arrangement leaves the low and medium frequencies produced by the lower-frequency transducer, including those encompassing a significant portion of the human vocal spectrum, with an uncontrolled dispersion pattern.

The resultant −6 decibel beamwidth as a function of frequency for a typical prior art loudspeaker is depicted in FIG. 1. The main area of interest is from about 800 Hz to approximately 2.5 KHz, above which the high-frequency transducer's waveguide begins to control its dispersion pattern. As seen in FIG. 1, the beamwidth between point 1 (800 Hz) and point 2 (2.5 KHz) remains at a value of approximately 200 degrees, which is undesirably large compared to a beamwidth between 50 and 100 degrees for the frequency band above 4000 Hz. When the listener is located beyond some relatively minimal distance from the loudspeaker, the high frequencies occupying the spectrum at 3000 Hz and above will be focused on the listener to a greater degree than the band of frequencies below 3000 Hz, resulting in a large portion of the vocal intelligibility and musical detail being lost.

The directivity index (DI) and directivity factor (Q) for a typical prior art loudspeaker is depicted in FIG. 3. The directivity factor expresses the gain in the peak on axis direction with reference to a theoretical omnidirectional source having the same radiated power, while the directivity index is ten times the logarithm of the directivity factor, in decibels. As seen in FIG. 3, the DI and corresponding Q between point 3 (800 Hz) and point 4 (2.5 KHz) is relatively low compared to the higher frequencies, indicating relatively poor directional focus at these frequencies.

Ideally, a flush mounted coaxial ceiling speaker should utilize a waveguide optimized for the medium and lower frequencies produced by the lower-frequency transducer in addition to a waveguide designed for the higher frequencies produced by the high-frequency transducer, thereby increasing vocal intelligibility and the accuracy of musical reproduction when utilized in a high ceiling application. The ideal speaker system should also include a port to increase the lower-frequency output of the speaker, and include a line transformer switch accessible from the front of the speaker.

SUMMARY OF THE INVENTION

The present invention includes a flush mountable coaxial ceiling speaker with a lower-frequency transducer waveguide coaxially aligned with a high-frequency transducer waveguide. The dual waveguides focus a wider spectrum of sound into a relatively narrower pattern, thereby projecting the sound further than a ceiling speaker with only a high-frequency waveguide or no waveguide at all. The projected sound is both louder and more intelligible within a well-defined listening plane at relatively greater distances. This characteristic allows the coaxial loudspeaker with multiple waveguides to be placed relatively farther away from the listener, thereby permitting the use of the present invention in association with relatively high ceiling (18'–25') applications. The present invention also incorporates a forward facing port and transformer switch, both of which are housed within the lower-frequency waveguide in order to facilitate access by the speaker installer while minimizing the overall diameter of the speaker system.

DETAILED DESCRIPTION OF THE INVENTION

Figure 1:
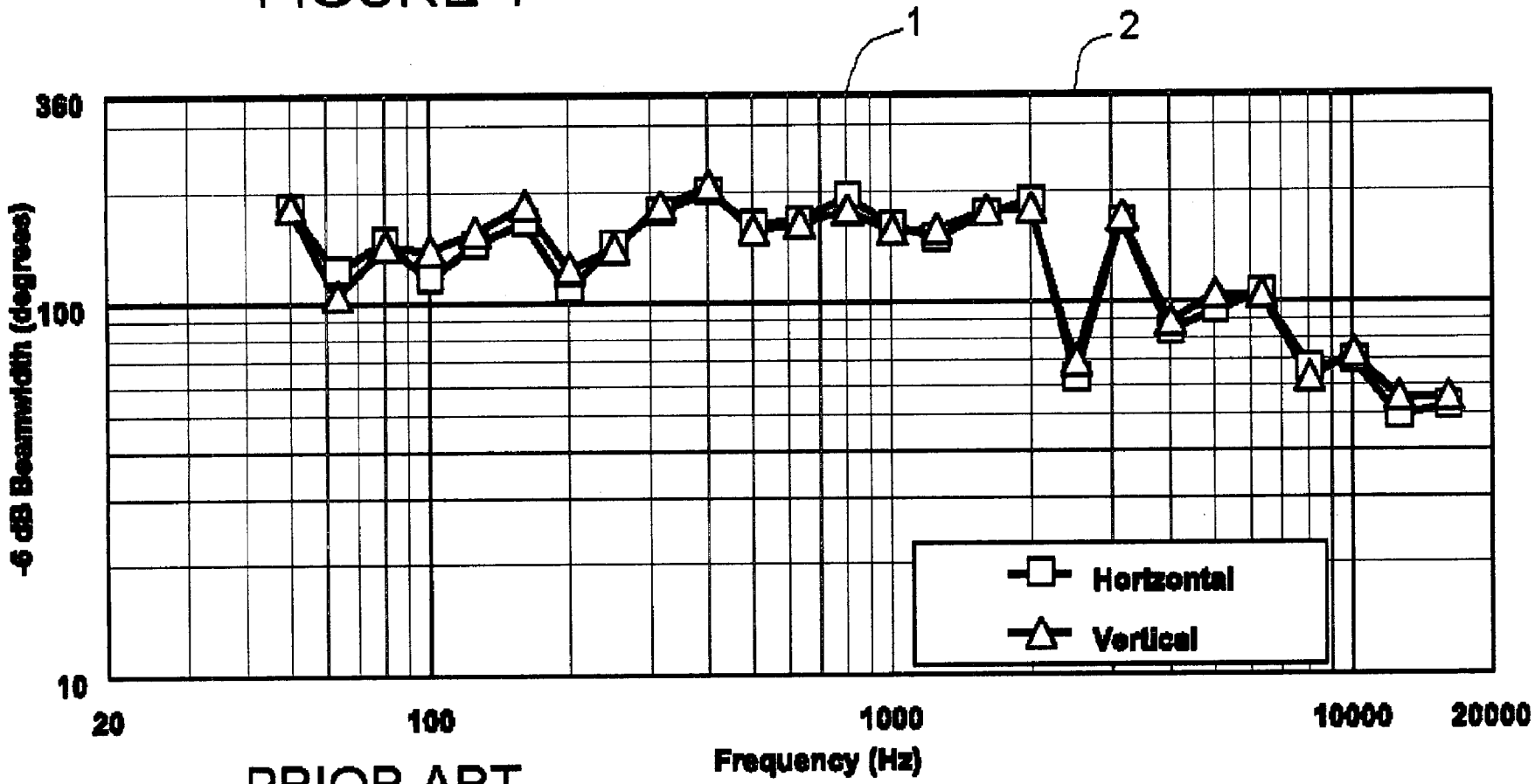
FIGURE 1 PRIOR ART
FIG. 1 is a graph depicting the typical horizontal and vertical beamwidth as a function of frequency for a prior art flush mounted ceiling speaker.
Figure 3:
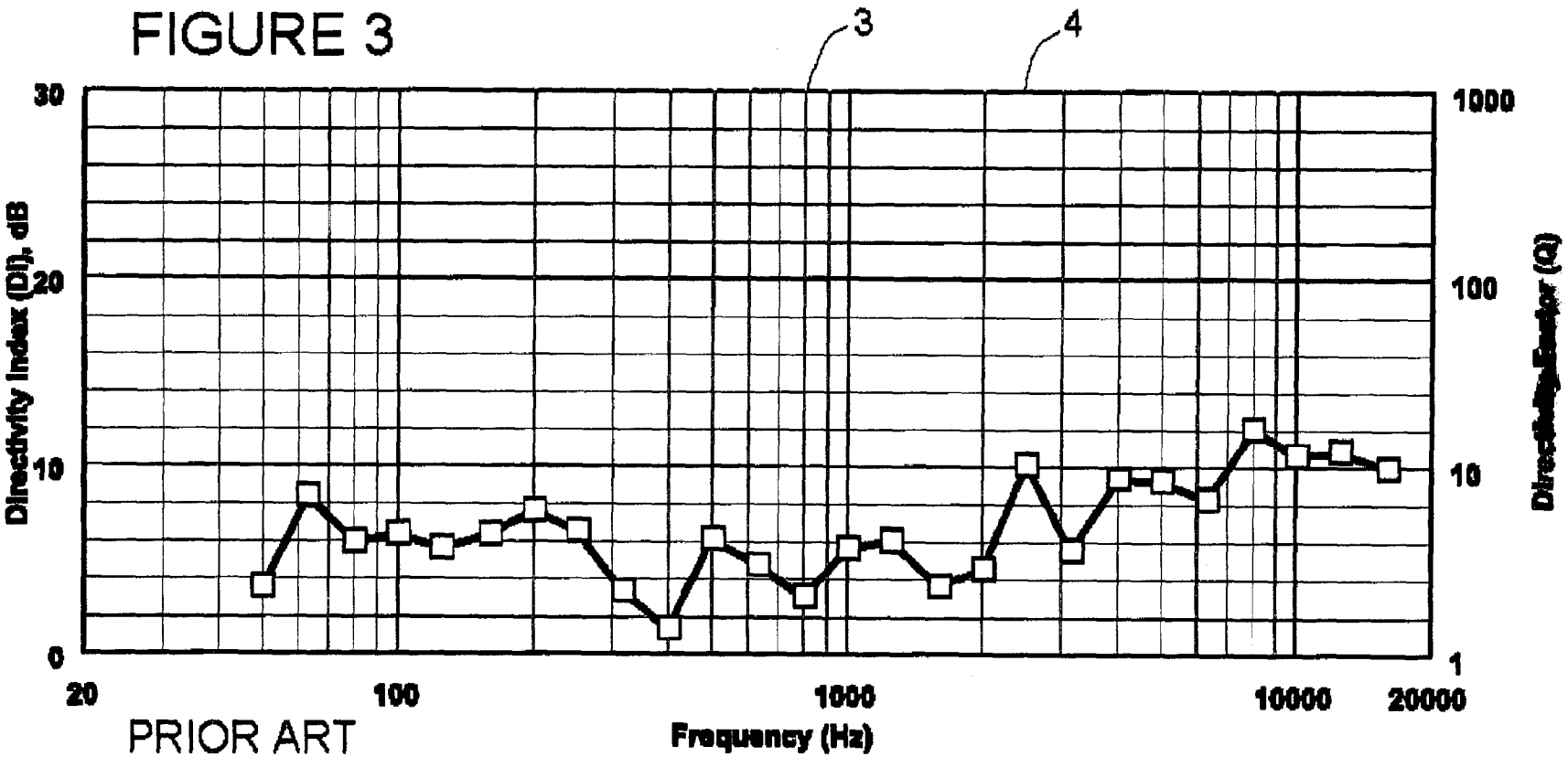
FIGURE 3 PRIOR ART
FIG. 3 is a graph depicting the typical directivity index and directivity factor as a function of frequency for a prior art flush mounted ceiling speaker.

FIGS. 1 and 3 have been described above in connection with conventional flush mounted ceiling loudspeaker systems. Such speakers may utilize a single waveguide optimized for improved high-frequency transducer performance at the higher frequencies. The lack of a mechanism to control lower-frequency dispersion pattern limits the distance that intelligible sound may be projected over this lower frequency range.

Figure 2:
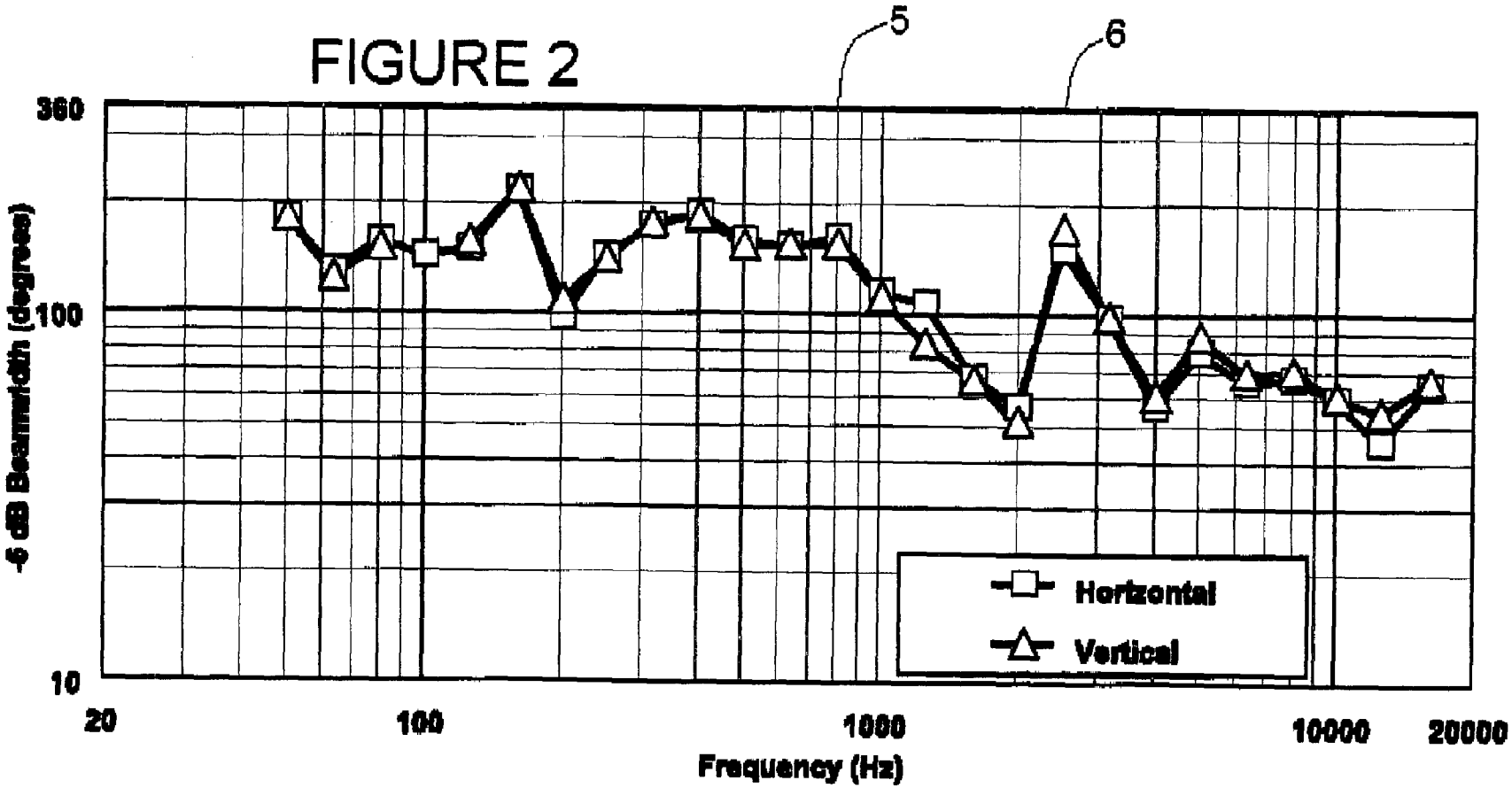
FIG. 2 is a graph depicting the typical horizontal and vertical beamwidth as a function of frequency for a loudspeaker system constructed according to the principles of the present invention.

FIG. 2 is a graph showing the beamwidth as a function of frequency for the loudspeaker of the present invention. At point 5 (800 Hz) the beamwidth is approximately 160 degrees, but begins to decrease steadily to a value of 50 degrees before reaching point 6 (2.5 KHz). This narrowing of the beamwidth between points 5 and 6 enables the lower-frequency range to be projected to greater distances than the relatively wider beamwidth shown between points 1 and 2 in FIG. 1. Such increased listener distances are typically encountered when mounting the loudspeaker of the present invention in a relatively high ceiling, such as might be encountered in a church or school.

Figure 4:
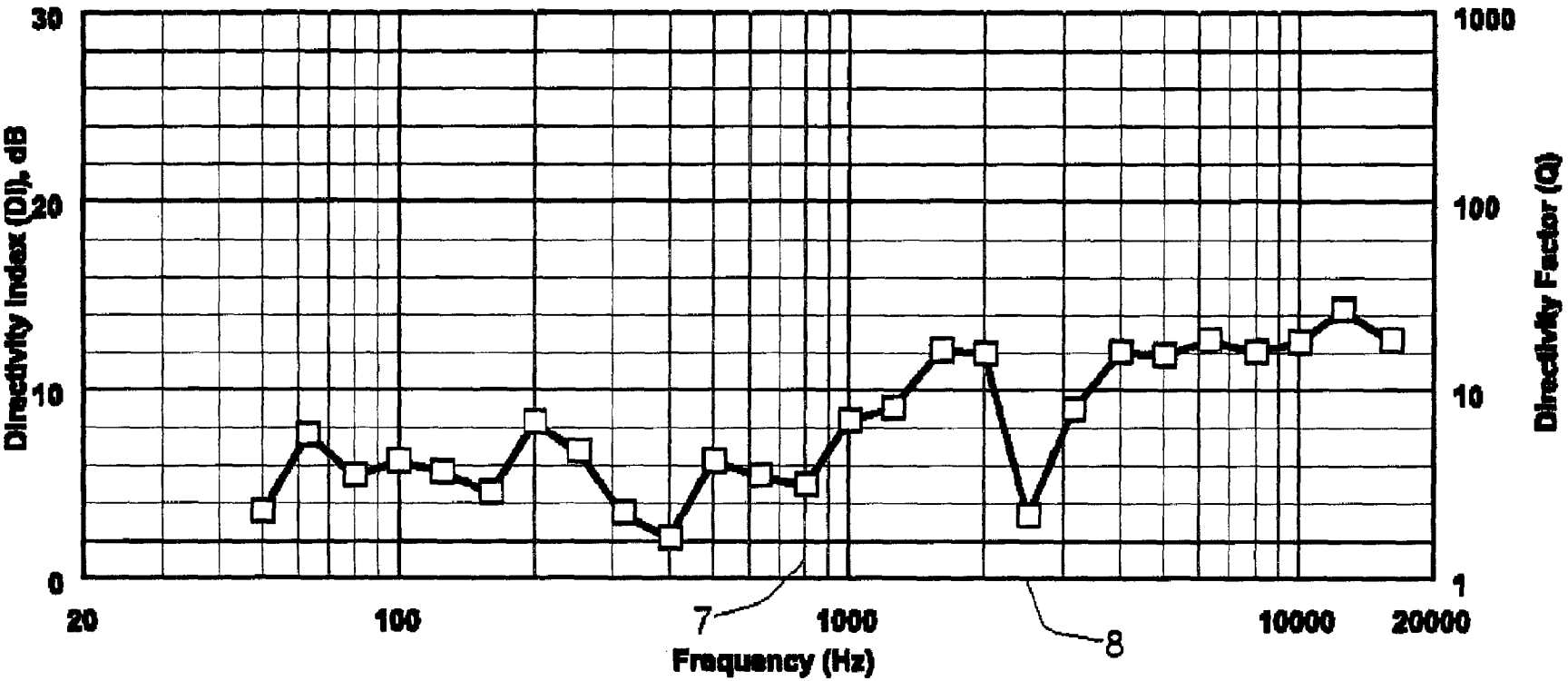
FIG. 4 is a graph depicting the directivity index and directivity factor as a function of frequency for a loudspeaker system constructed according to the principles of the present invention.

FIG. 4 is a graph showing the directivity index (DI) and directivity factor (Q) as a function of frequency for the loudspeaker of the present invention. The DI value at point 8 (800 Hz) is approximately five decibels, but steadily increases until the DI value is approximately 12 decibels prior to reaching point 9 (2.5 KHz). This is in contrast to the directivity index and directivity factor graph depicted in FIG. 3, which shows a DI value of approximately 3 decibels at point 3 (800 Hz), increasing to a maximum of 10 decibels at point 4 (2.5 KHz). The average directivity index value between points 3 and 4 is relatively lower than the average DI value between points 7 and 8. The present invention has a narrower beamwidth than the loudspeaker characteristics depicted FIG. 3 due to the presence of the lower-frequency waveguide which tends to focus the radiated sound within the lower frequency range, thereby projecting a relatively greater portion of the radiated sound for a relatively greater distance from (below) the loudspeaker.

Figure 5:
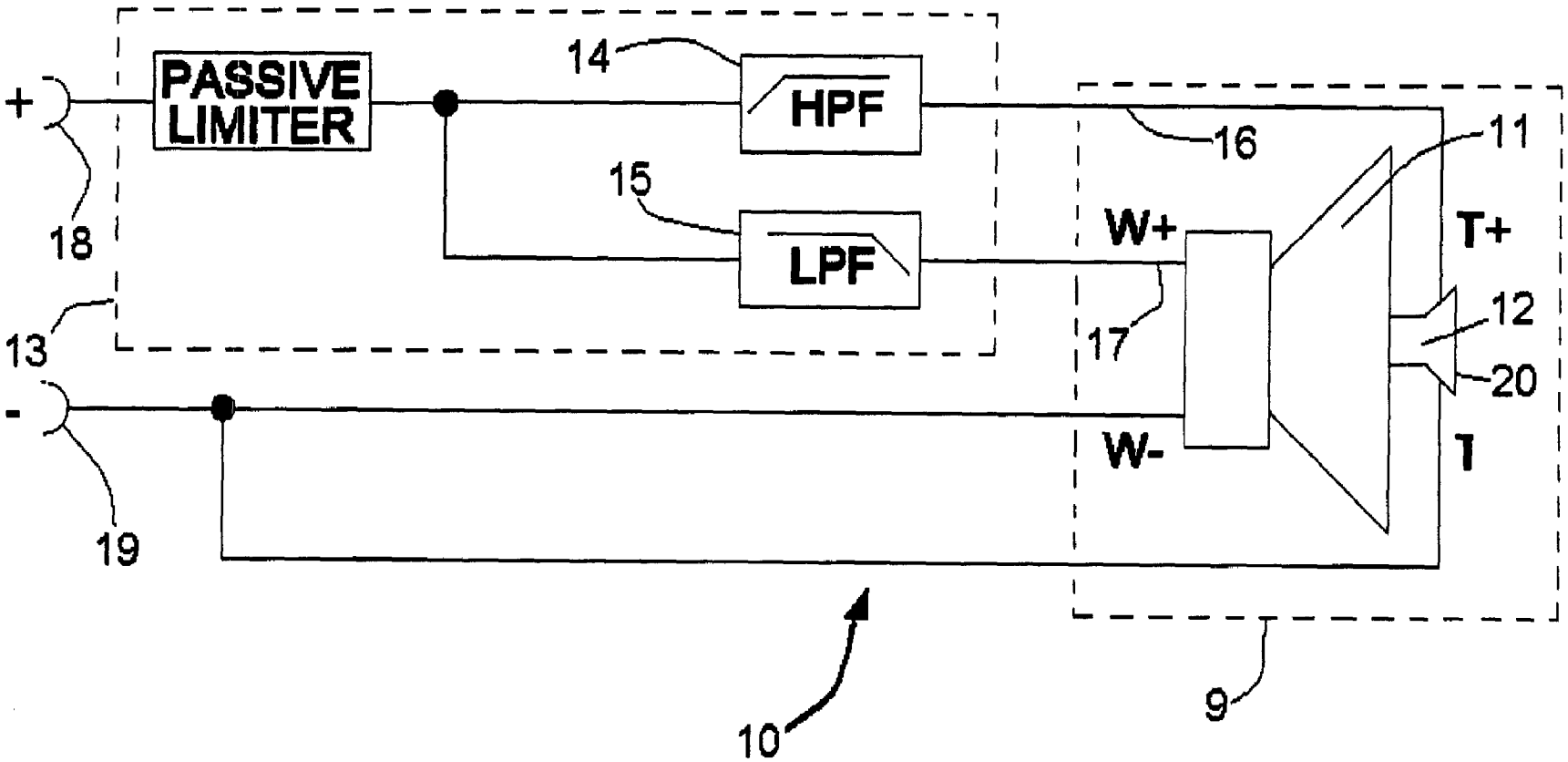
FIG. 5 is a block diagram of a coaxial loudspeaker and crossover network used in the system of the present invention.

FIG. 5 is a block diagram of the coaxial loudspeaker system 10 of the present invention and including a high-frequency waveguide 20. The system 10 includes the coaxial loudspeaker 9, constructed so as to have a lower-frequency transducer 11 and a high-frequency transducer 12, coupled with the high-frequency waveguide 20. The crossover network 13 includes a high pass filter 14 which forwards its higher-frequency band output signal 16 to the high-frequency transducer 12. A low pass filter 15 forwards its lower-frequency band output signal 17 to the lower-frequency transducer 11. The signal containing the entire frequency spectrum is introduced to the speaker system 10 at terminals 18 and 19.

Figure 6:
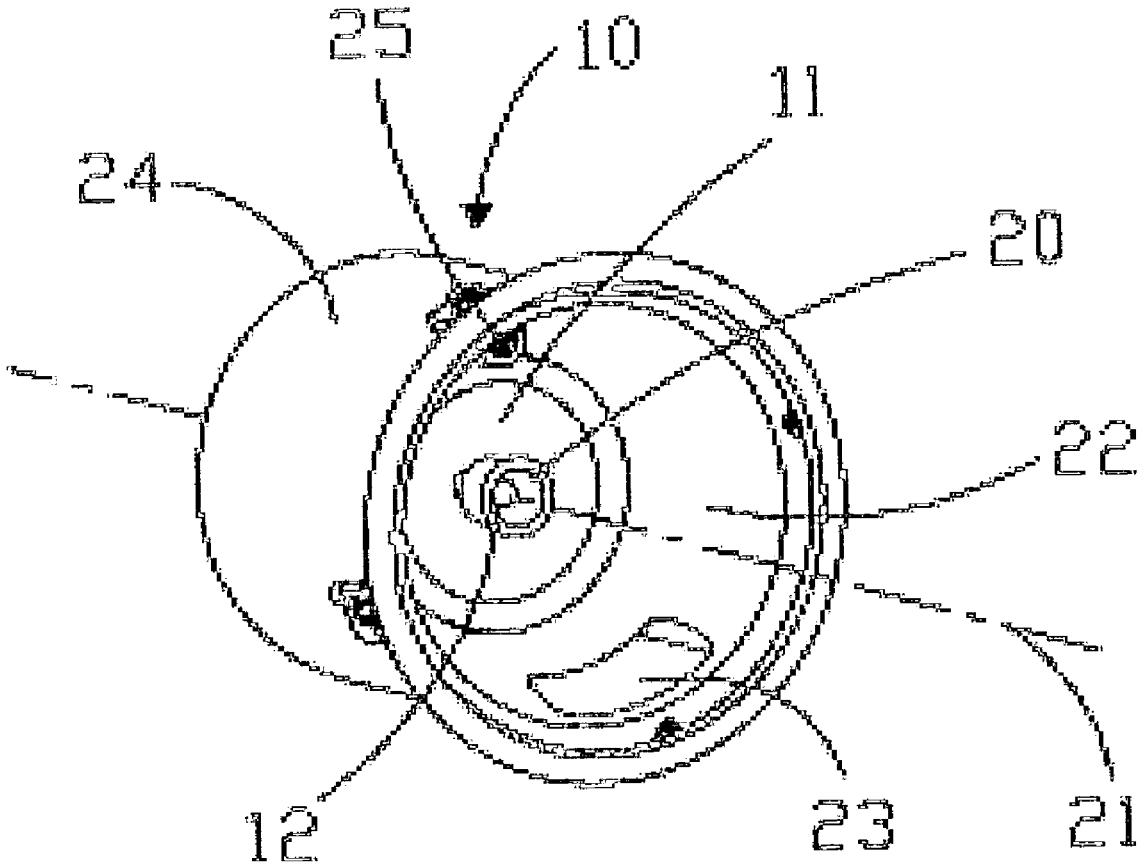
FIG. 6 is a first perspective view of a loudspeaker constructed according to the principles of the present invention.

FIG. 6 is a perspective view showing the assembled loudspeaker system 10 including the lower-frequency transducer 11 and the high-frequency transducer 12. The high-frequency waveguide 20 is coupled coaxially with the high-frequency transducer 12. Mounted behind the high-frequency transducer 12 and waveguide 20 is the lower-frequency transducer 11, which is coaxially aligned with the longitudinal axis 21 of high-frequency transducer 12 and waveguide 20. Also mounted coaxially with the axis 21 is the lower-frequency waveguide 22, constructed to include a port 23 and adjustable switch 25. The port 23 is seen to be an integral part of the lower-frequency waveguide, as is the adjustable switch 25. The combination of high-frequency transducer 12, lower-frequency transducer 11, high-frequency waveguide 20 and lower-frequency waveguide 22 is mounted within a rigid housing 24. The housing 24 is formed substantially as a cylinder having a diameter 30 (FIG. 8) that is slightly greater than the lower-frequency waveguide diameter 34 (FIG. 10) so as to permit the lower-frequency waveguide 22 to reside within the cylinder 24 in an abutting relationship.

Figure 7:
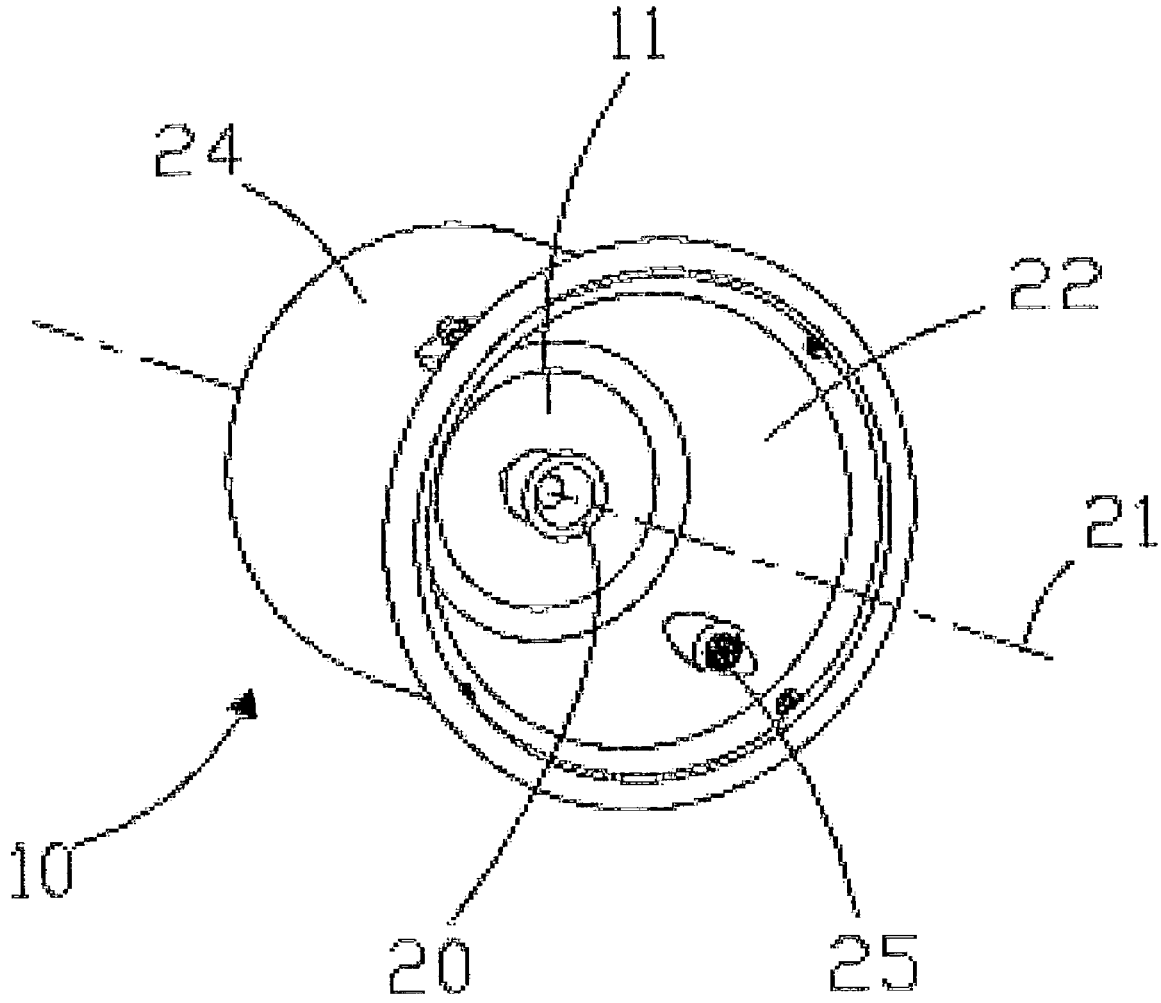
FIG. 7 is a second perspective view of the loudspeaker depicted in FIG. 6.

FIG. 7 is another perspective view of the coaxial loudspeaker system 10 in which the forwardly facing line transformer switch 25 is best seen. The switch 25 is seen to be an integral part of the lower-frequency waveguide 22.

Figure 8:
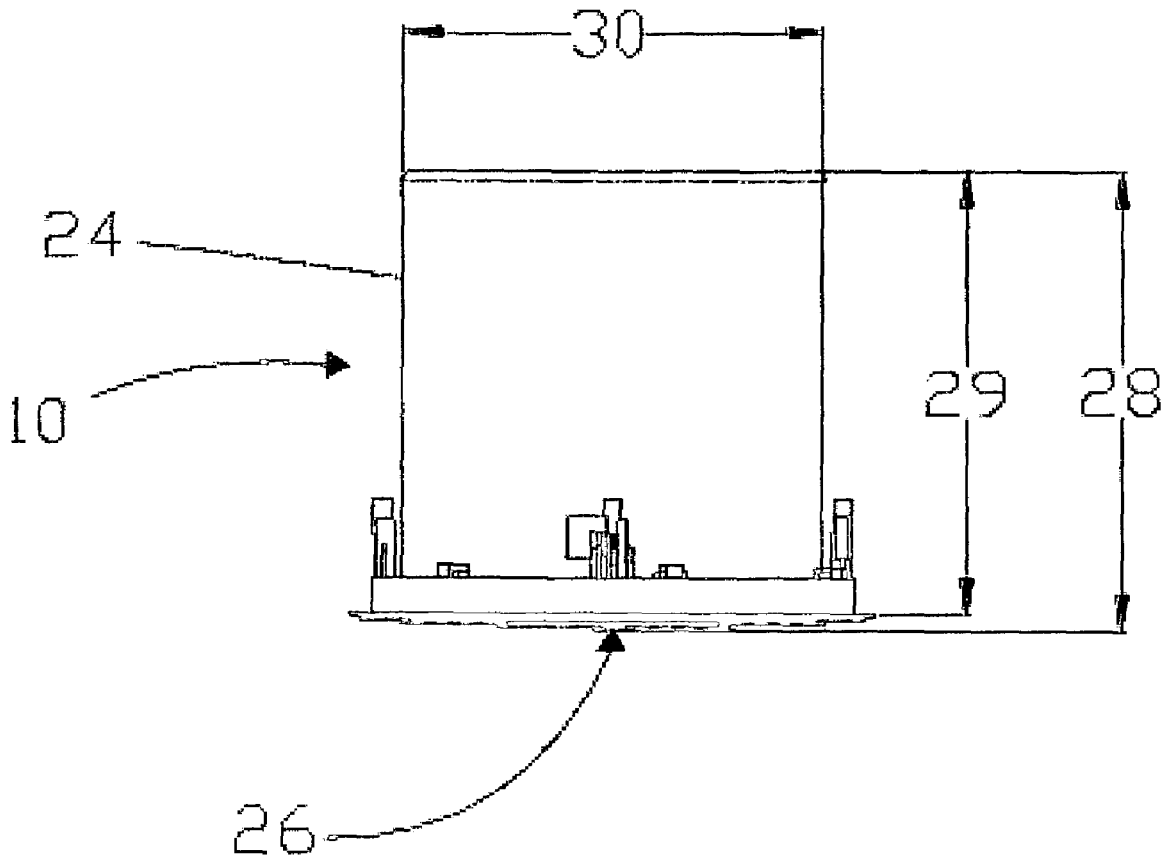
FIG. 8 is a side elevation of the loudspeaker depicted in FIG. 6.

As seen in FIG. 8, the assembled loudspeaker 10 includes a front protective grille 26. The overall height 28 of the entire assembly 10 is approximately 340 mm. In a preferred embodiment, the housing 24 has a height 29 of approximately 303 mm. The diameter 30 is approximately 303 mm.

In this preferred embodiment, the total weight of the assembly 10 is approximately 6.0 kg.

Figure 9:
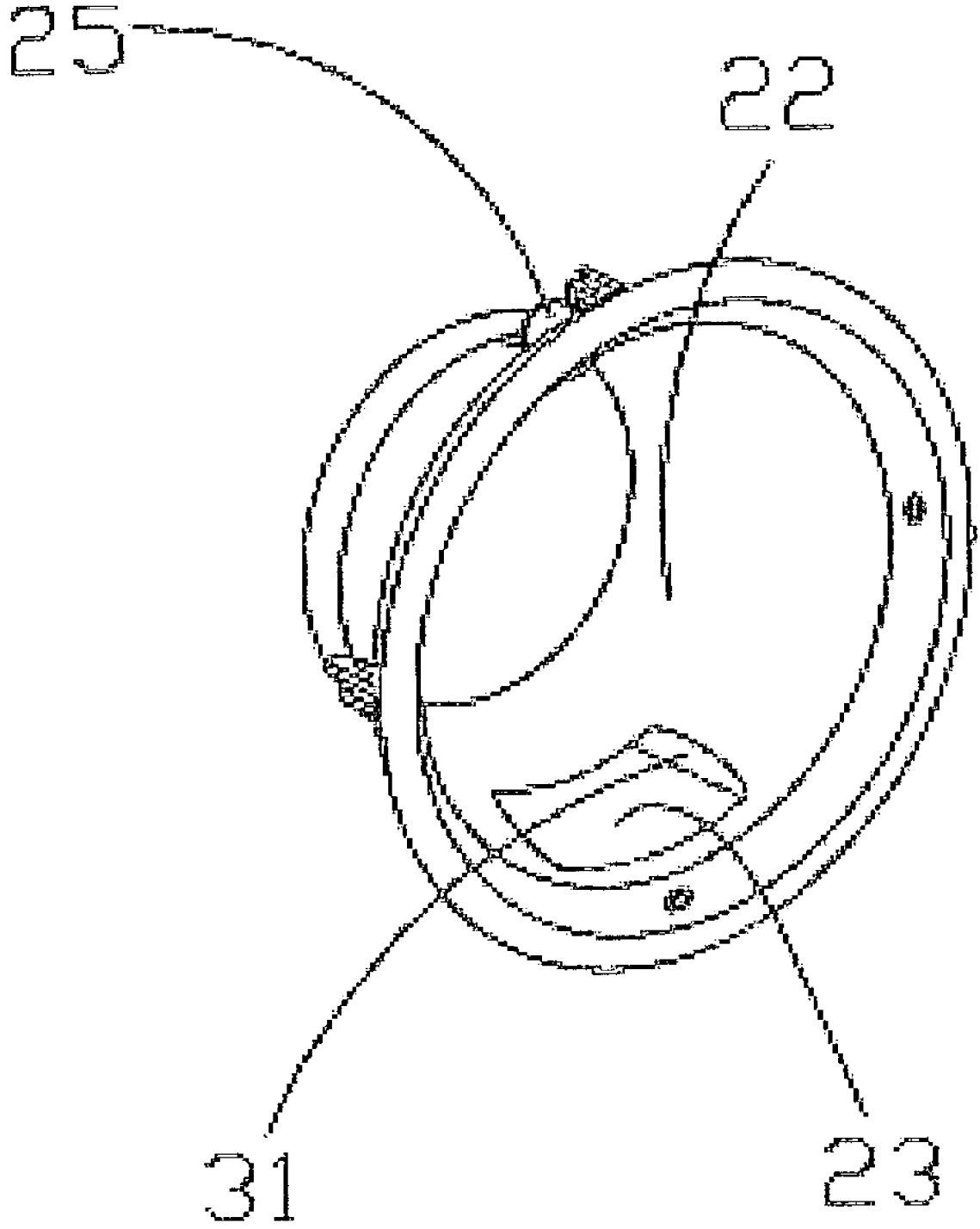
FIG. 9 is a perspective view of the lower-frequency waveguide utilized in the loudspeaker depicted in FIG. 6.
Figure 12:
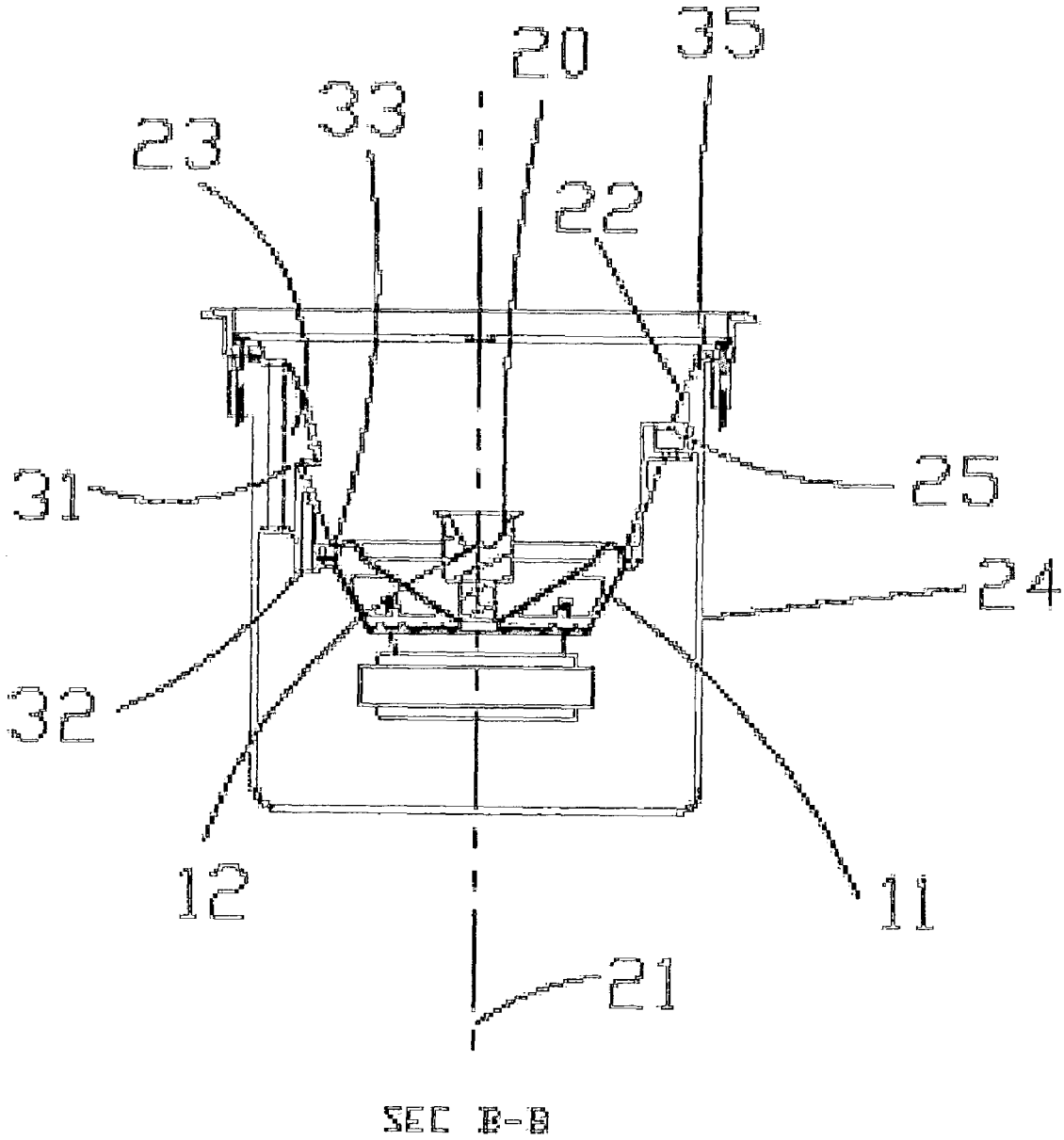
FIG. 12 is a sectional view taken along line B—B of the loudspeaker depicted in FIG. 10.

FIG. 9 depicts the lower-frequency waveguide 22 without the presence of the other components. Referring also to FIG. 12, the port 23 is seen to include a wall 31 that extends in a direction substantially parallel to the longitudinal axis 21. The trailing edge 32 of the port structure 23 extends to a region behind the leading edge 33 of the lower-frequency transducer 11.

Figure 10:
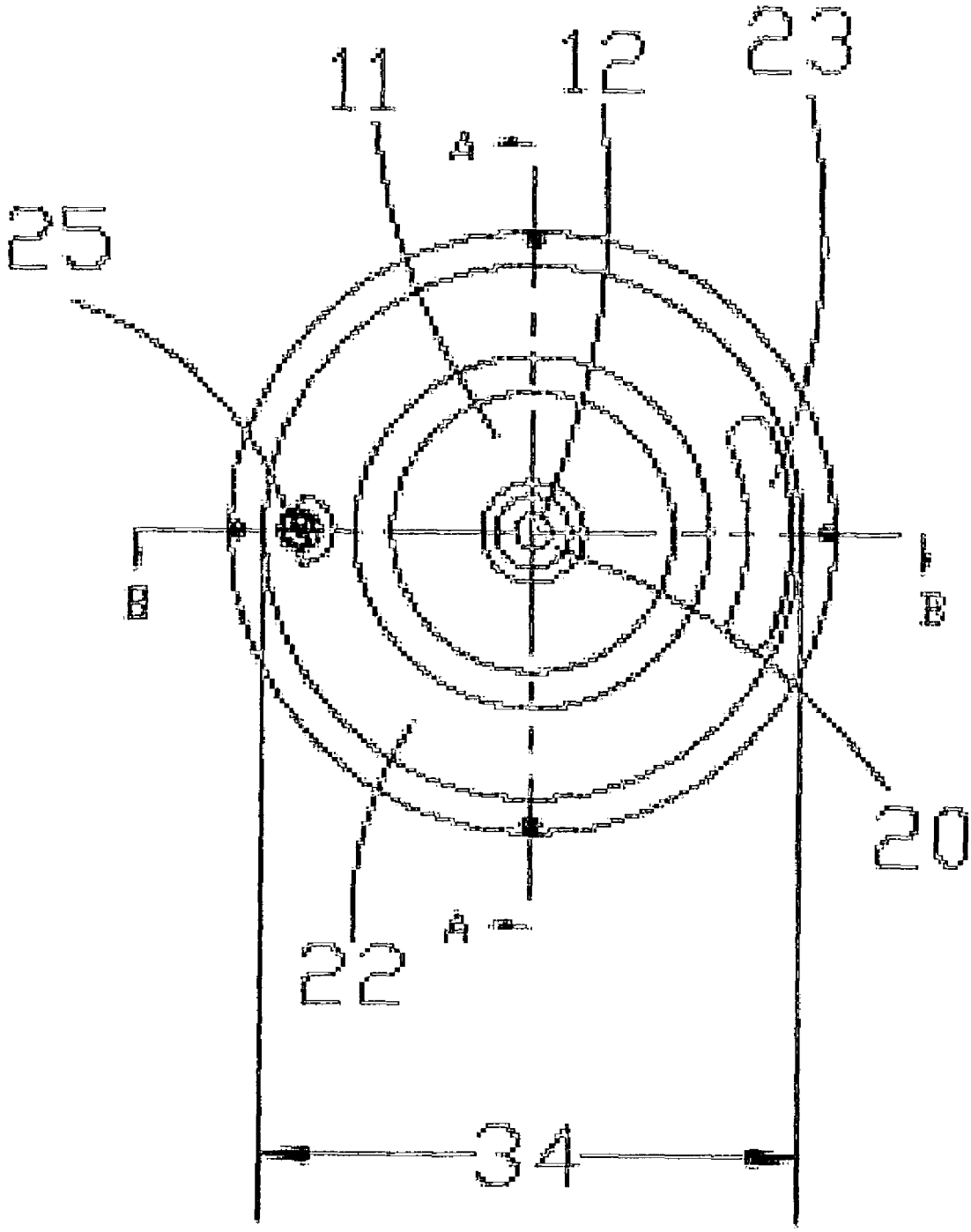
FIG. 10 is a top plan view of the loudspeaker depicted in FIG. 6

FIG. 10 is a top plan view showing the port 23 and adjustable switch 25 residing within the lower frequency waveguide 22, thereby resulting in a relatively smaller overall diameter of the loudspeaker assembly 10. The lower-frequency transducer 11, lower-frequency waveguide 22, high-frequency transducer 12 and high-frequency waveguide 20 are concentric with one another.

Figure 11:
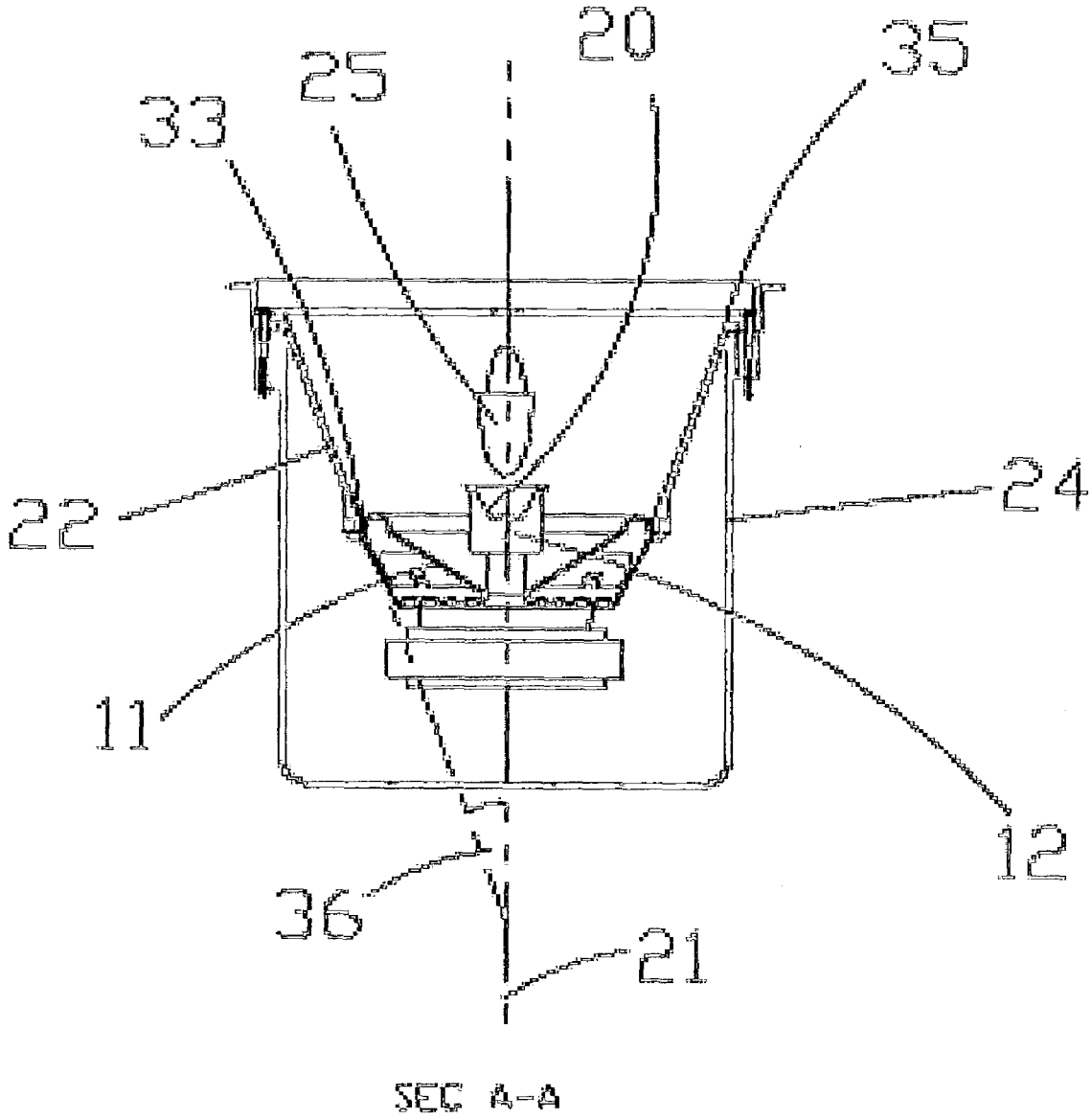
FIG. 11 is a sectional view taken along line A—A of the loudspeaker depicted in FIG. 10.

FIGS. 11 and 12 depict the relative positions of the high-frequency waveguide 20 and the lower-frequency waveguide 22. The lower-frequency waveguide 22 substantially surrounds the portion of the longitudinal axis 21 residing within the housing 24 in the region extending from the leading edge 33 of the lower-frequency transducer 11 to the outer edge 35 of the housing 24. The angle 36 formed between the waveguide 22 and the longitudinal axis 21 is such that the beamwidth produced by the lower-frequency waveguide 22 is substantially equal to the beamwidth produced by the high-frequency waveguide 20 over a large portion of the vocal intelligibility band. Due to the coaxial placement of the transducers and waveguides, the sonic energy radiated from the lower-frequency transducer 11 is shaped by the lower-frequency waveguide 22. The lower frequency radiation is then combined with the sonic energy radiated by the high-frequency transducer 12 and shaped by the high-frequency waveguide 20 to create a coherent, uniformly controlled coverage pattern.

While the specific characteristics of one embodiment of the present invention have been set forth, numerous adjustments may be made to the invention based on specific requirements of the user. In particular, the frequency spectrum of interest may not be as broad as the entire audible range, and even applications devoted to human speech may have spectral requirements with narrower or broader bandwidths than those described. The profile created by angle 36 could be straight, curved, or have a multi-angular profile to achieve a substantially equal beamwidth for varying frequency ranges and applications. If the beamwidth of a high-frequency transducer is desirable without the aid of a high-frequency waveguide, the lower-frequency waveguide may still be utilized and formed to match the high frequency beamwidth.

What is claimed is:

1. A loudspeaker capable of radiating sonic energy having improved directional characteristics over a selected frequency spectrum, comprising;

a lower-frequency transducer, the lower-frequency transducer having a first longitudinal axis; a high frequency transducer, the high-frequency transducer having a second longitudinal axis, the high-frequency transducer being mounted such that the first longitudinal axis is coaxial with the second longitudinal axis; a lower-frequency waveguide, the lower-frequency waveguide having a third longitudinal axis and being coupled to the lower-frequency transducer such that the third longitudinal axis is substantially coaxial with the first and second longitudinal axis; the lower-frequency waveguide having a first diameter and a high-frequency waveguide, the high-frequency waveguide having a fourth longitudinal axis and being coupled to the high-frequency transducer such that the high frequency waveguide is concentric with the low frequency waveguide and the fourth longitudinal axis is substantially coaxial with the first, second and third longitudinal axis.

2. The loudspeaker of claim 1, further comprising a housing, the housing being adapted to contain the transducers and the waveguides, the housing permitting mounting of the loudspeaker on a planar surface.

3. The loudspeaker of claim 2, wherein the housing is formed substantially as a cylinder having an inner diameter, the inner diameter being slightly greater than the first diameter so as to permit the lower-frequency waveguide to reside within the cylinder in an abutting relationship.

4. The loudspeaker of claim 3, wherein the housing has an outer edge, the lower-frequency waveguide extending from the lower-frequency transducer to a position adjacent to the outer edge of the housing.

5. The loudspeaker of claim 4, wherein the lower-frequency waveguide substantially surrounds the longitudinal axis residing within the housing in a region extending from a leading edge of the lower-frequency transducer to the outer edge of the housing.

6. The loudspeaker of claim 5, wherein the sonic energy radiated from the lower-frequency waveguide coupled to the lower-frequency transducer is combined with the sonic energy radiated from the high-frequency waveguide coupled to the high-frequency transducer to create a coherent, uniformly controlled coverage pattern.

7. A loudspeaker adapted for flush mounting within a substantially planar ceiling, comprising: a high-frequency transducer adapted for reproducing high-frequency sonic energy; a lower-frequency transducer adapted for reproducing lower-frequency sonic energy, the high-frequency transducer and lower-frequency transducer being aligned along a common axis;

a high-frequency waveguide coupled to the high-frequency transducer so as to control the dispersion pattern of the sonic energy produced by the high-frequency transducer, the high-frequency waveguide being substantially coaxial to the common axis; and a lower-frequency waveguide coupled to the lower-frequency transducer so as to control the dispersion pattern of the sonic energy produced by the lower-frequency transducer, the lower-frequency waveguide being substantially concentric with the high frequency waveguide.

8. The loudspeaker of claim 7, further comprising a substantially cylindrical housing having a diameter adapted to receive a largest diameter of the lower-frequency waveguide in an abutting relationship.

9. The loudspeaker of claim 8, wherein the lower-frequency waveguide further comprises a forwardly projecting port.

10. The loudspeaker of claim 9, wherein the lower-frequency waveguide further comprises an adjustable switch, the switch being accessible from a forward facing region of the loudspeaker.

11. A method of producing a composite sonic energy signal of substantially uniform amplitude across a selected portion of an audio spectrum, comprising the steps of:

coupling a high-frequency waveguide to a high-frequency transducer along a common axis;

coupling a lower-frequency waveguide to a lower-frequency transducer along the common axis such that the low-frequency wave guide is substantially concentric with the high-frequency waveguide.

12. The method of claim 11, further comprising the step of forming the lower-frequency waveguide and the high-frequency waveguide to have substantially equal beam-widths.

13. The method of claim 12, further comprising the step of forming a forward facing port within a sidewall of the lower-frequency waveguide.

14. The method of claim 13, further comprising the step of forming an adjustable switch within a sidewall of the lower-frequency waveguide.

15. The method of claim 14, further comprising the step of mounting the waveguides and the transducers within a substantially cylindrical housing adapted to be flush mounted within a planar ceiling.

* * * * *